US012540420B2

(12) United States Patent
Dalton et al.

(10) Patent No.: US 12,540,420 B2
(45) Date of Patent: Feb. 3, 2026

(54) HEATED SOLUTION ELECTROSPINNING

(71) Applicant: University of Oregon, Eugene, OR (US)

(72) Inventors: Paul D. Dalton, Eugene, OR (US); Ievgenii Liashenko, Eugene, OR (US)

(73) Assignee: University of Oregon, Eugene, OR (US)

( * ) Notice: Subject to any disclaimer, the term of this patent is extended or adjusted under 35 U.S.C. 154(b) by 161 days.

(21) Appl. No.: 18/500,960

(22) Filed: Nov. 2, 2023

(65) Prior Publication Data

US 2025/0146183 A1 May 8, 2025

(51) Int. Cl.

| | |
|---|---|
| ***D01D 1/02*** | (2006.01) |
| ***D01D 4/02*** | (2006.01) |
| ***D01D 5/00*** | (2006.01) |
| ***D01D 7/00*** | (2006.01) |

(52) U.S. Cl.

CPC ..... *D01D 5/0038* (2013.01); *D01D 5/0061* (2013.01); *D01D 5/0069* (2013.01); *D10B 2331/041* (2013.01)

(58) Field of Classification Search

CPC ..... D01D 1/02; D01D 4/02; D01D 5/003; D01D 5/0038; D01D 5/0061; D01D 5/0069; D01D 7/00; D10B 2331/041

USPC ..... 264/211.12, 331.21, 464, 465, 466, 484; 425/174.8 E, 224, 461, 462, 463, 464

See application file for complete search history.

(56) References Cited

U.S. PATENT DOCUMENTS

| | | | | |
|---|---|---|---|---|
| 2002/0100725 | A1 | 8/2002 | Lee et al. | |
| 2009/0091065 | A1* | 4/2009 | Katti | D01D 5/0092 264/465 X |
| 2009/0108503 | A1* | 4/2009 | Scott-Carnell | D01D 5/0084 425/174.8 E |
| 2009/0189318 | A1* | 7/2009 | Kim | D01D 5/0061 264/465 X |

FOREIGN PATENT DOCUMENTS

| | | | | |
|---|---|---|---|---|
| CN | 106 332 460 | | 1/2017 | |
| KR | 20120077245 A | * | 7/2012 | D01D 5/0069 |

OTHER PUBLICATIONS

International Search Report, International Application No. PCT/US2024/053566, 5 pages, Mar. 4, 2025.

Written Opinion, International Application No. PCT/US2024/053566, 12 pages, Mar. 4, 2025.

Yang et al., "Influence of Working Temperature on The Formation of Electrospun Polymer Nanofibers," *Nanoscale Research Letters*, vol. 12, No. 1, pp. 1-10, Jan. 19, 2017.

(Continued)

*Primary Examiner* — Leo B Tentoni

(74) *Attorney, Agent, or Firm* — Klarquist Sparkman, LLP

(57) ABSTRACT

Certain aspects of the disclosure concern a device including a nozzle configured to receive a heated polymer solution from a reservoir and a power supply configured to generate an electrostatic field between a tip portion of the nozzle and a substrate so as to draw a charged jet of the heated polymer solution out of the tip portion of the nozzle toward a substrate situated at an operating distance from the tip portion of the nozzle and form a polymer fiber on the substrate. The heated polymer solution is at an operating temperature that is greater than or equal to 40° C.

20 Claims, 9 Drawing Sheets

(56) References Cited

OTHER PUBLICATIONS

Desai et al., "Effect of spinning temperature and blend ratios on electrospun chitosan/poly(acrylamide) blends fibers," *In Polymer*, vol. 49, No. 19, pp. 4046-4050, Sep. 9, 2008.
ElectrospinTech, "Environment," electrospintech.com/environment.html#.Y08-7XbMKUk, 9 pages, Jun. 14, 2012.
ElectrospinTech, "Addressing the needs of nanofiber mass production (Limitation of nozzle system)," electrospintech.com/mpchallenge.html#.Y08-8XbMKUk, 9 pages, Mar. 19, 2023.
Wikipedia, "Electrospinning," https://en.wikipedia.org/wiki/Electrospinning, 11 pages (accessed Oct. 18, 2022).
Wikipedia, "Melt electrospinning," https://en.wikipedia.org/wiki/Melt_electrospinning, 5 pages (accessed Oct. 18, 2022).
Xue et al., "Electrospinning and Electrospun Nanofibers: Methods, Materials, and Applications," *Chem. Rev.* 119(8), 254 pages, Apr. 24, 2019.
Abbas et al., "Active solution heating and cooling in electrospinning enabling spinnability from various solvents," *Journal of Applied Polymer Science*, 11 pages, 2022.

* cited by examiner

310

320

HEATED SOLUTION ELECTROSPINNING

FIELD

The present disclosure concerns systems and methods related to electrospinning technologies.

BACKGROUND

Electrospinning is a fiber production method that uses electric force to draw charged threads of polymer solutions or polymer melts to fiber diameters in the order of few micrometers or less. In general, electrospinning can be performed using either polymer melts (also known as "melt electrospinning") or polymer solutions (also known as "solution electrospinning"). In solution electrospinning, a polymer of interest is solubilized or dissolved in a volatile solvent to form a polymer solution, which is electrospun, typically at room temperature, to produce fibers. In contrast to solution electrospinning, melt electrospinning does not need volatile solvents. Instead, a polymer of interest is heated above its melting point (also referred to as "melting temperature") so as to become a polymer melt, which can be electrospun to produce fibers. Both electrospinning technologies have their respective uses and limitations. For example, solution electrospinning generally lacks reproducibility due to its sensitivity to multiple operational and environmental conditions, whereas melt electrospinning generally cannot produce thinner nanofibers that are achievable with solution electrospinning. Thus, improved approaches are needed, particularly those that can produce thin nanofibers with reduced sensitivity to fabrication parameters.

SUMMARY

Described herein are apparatuses, systems, and methods for heated solution electrospinning technology, which overcome one or more of the deficiencies of conventional melt electrospinning and solution electrospinning technologies.

Certain examples of the disclosure concern a device including a nozzle configured to receive a heated polymer solution from a reservoir and a power supply configured to generate an electrostatic field between a tip portion of the nozzle and a substrate so as to draw a charged jet of the heated polymer solution out of the tip portion of the nozzle toward a substrate situated at an operating distance from the tip portion of the nozzle and form a polymer fiber on the substrate. The heated polymer solution is at an operating temperature that is greater than or equal to 40° C.

In some examples, the device includes a heating container situated to provide the heated polymer solution to the nozzle.

In some examples, the heating container encloses the reservoir and a body portion of the nozzle, wherein the tip portion of the nozzle extends out of the heating container.

In some examples, the tip portion of the nozzle extending out of the heating container has an axial length between 0.5 mm and 3 mm, inclusive.

In some examples, the heated polymer solution includes a solvent and a polymer dissolved in the solvent. The heating container can be configured to maintain the heated polymer solution at the operating temperature. The operating temperature is below a boiling temperature of the solvent.

In some examples, the operating temperature is below a melting point of the polymer.

In some examples, the polymer includes polycaprolactone and the solvent includes dimethylformamide. The operating temperature can be between 40° C. and 100° C., inclusive.

In some examples, the polymer has a concentration between 10-50 wt. % (inclusive) in the heated polymer solution at the operating temperature.

In some examples, the tip portion of the nozzle has an opening with an inner diameter between 50 μm and 1 mm, inclusive.

In some examples, the operating distance is between 5 mm and 30 mm, inclusive.

In some examples, the device further includes a collector configured to retain the substrate. The collector can be configured to move relative to the nozzle.

In some examples, the nozzle is one of a plurality of nozzles configured to receive the heated polymer solution which is electrospun into charged jets escaping from the plurality of nozzles to form respective polymer fibers on the substrate. In some examples, a distance between two adjacent nozzles is between 50% and 250% (inclusive) of the operating distance.

In some examples, the substrate includes an electrically insulating material.

In some examples, the substrate includes an electrically conductive material.

In some examples, the substrate includes an electrically semiconductive material.

Certain aspects of the disclosure concern a method including heating a polymer solution to an operating temperature that is greater than or equal to 40° C., electrospinning the polymer solution as a charged jet escaping from a nozzle, and collecting a polymer fiber on a substrate. The polymer solution includes a polymer dissolved in a solvent at the operating temperature. The polymer fiber is formed from the charged jet after evaporation of at least some of the solvent.

In some examples, heating the polymer solution includes heating a reservoir and the nozzle containing the polymer solution.

In some examples, a distance between the nozzle and the substrate is between 5 mm and 30 mm, inclusive.

In some examples, the operating temperature is lower than a boiling temperature of the solvent.

In some examples, the polymer includes polycaprolactone and the solvent includes dimethylformamide.

In some examples, the electrospinning includes creating an electrostatic field between the nozzle and the substrate.

In some examples, the method further includes varying the operating temperature of the polymer solution while electrospinning the polymer solution so as to change evaporation rate of the solvent.

In some examples, collecting the polymer fiber includes moving the substrate relative to the nozzle.

In some examples, moving the substrate relative to the nozzle includes varying translation path of the substrate while electrospinning the polymer solution so as to adjust thickness of a membrane formed by the polymer fiber collected on the substrate.

Certain aspects of the disclosure concern another method including preparing a polymer solution comprising polycaprolactone dissolved in dimethylformamide, heating the polymer solution to an operating temperature that is between 40° C. and 100° C. (inclusive), feeding the polymer solution to a nozzle, applying an electrostatic field between a tip portion of the nozzle and a substrate spaced apart from the tip portion of the nozzle, the electrostatic field being configured to draw a charged jet of the polymer solution out of the tip portion of the nozzle toward the substrate, and collecting a fiber on the substrate. The fiber is formed from the charged jet after evaporation of at least some of the dimethylformamide.

Certain aspects of the disclosure concern yet another method including providing a polymer solution to a nozzle which has an opening that is clogged by a polymer precipitate, heating the nozzle to a melting temperature that is sufficient to melt the polymer precipitate to a polymer melt, pressuring the polymer melt out of the nozzle through the opening so that the nozzle is unclogged, electrospinning the polymer solution as a charged jet escaping from the nozzle, and collecting a polymer fiber on a substrate. The polymer fiber is formed from the charged jet after evaporation of at least some of a solvent in the polymer solution.

In some examples, the polymer solution includes a polymer dissolved in the solvent. In some examples, the method further includes maintaining the polymer solution at an operating temperature that is between 40° C. and 100° C., inclusive, while electrospinning the polymer solution.

The technology described herein can be used in a number of applications. For example, the technology described herein can be used to produce nano-scale fibers that have a strong plasticity, a flexible structure, and a large surface area-volume ratio. Such fibers can be used for fabrication of filtration media, textiles, coating material for medical devices, biocompatible membranes for tissue engineering, among others.

The membranes fabricated using the technology disclosed herein have many improvements over membranes fabricated using conventional electrospinning technologies, including, but not limited to, fewer defects, more homogenous fiber diameters, more controllable membrane thickness (e.g., local control of membrane thickness to produce a gradient of thickness), and controllable fusion between fibers. Importantly, compared to conventional electrospinning technologies, the heated solution electrospinning technology described herein can produce high-quality membranes with improved consistency and process stability over a wide range of operating and ambient conditions (e.g., in terms of environmental temperature, humidity, accelerating voltage, etc.), and is more scalable (e.g., by increasing the number of simultaneously operating nozzles without affecting the process stability) due to reduced operating distance. Moreover, unlike conventional electrospinning systems in which different solvents or their mixtures are used to control evaporation rate of the solvent mix to adjust the quality of fibers, the technology described herein can adjust the electrospinning conditions without changing a polymer solution by controlling evaporation rate of the same solvent used in the polymer solution through changing the operating temperature.

The foregoing and other features and advantages of the disclosed technologies will become more apparent from the following detailed description, which proceeds with reference to the accompanying figures.

DETAILED DESCRIPTION

General Considerations

Figure 1:
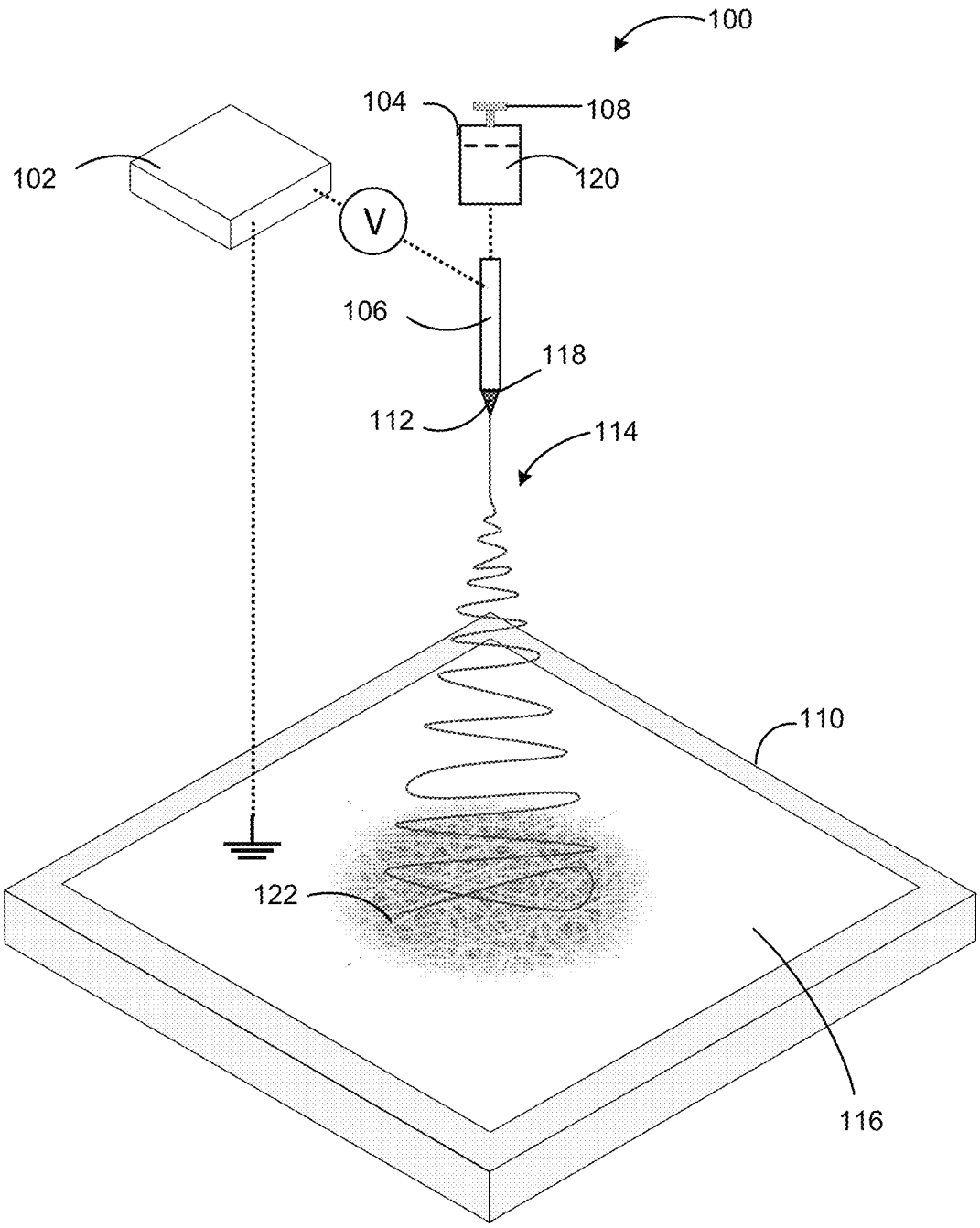
(PRIOR ART) FIG. 1
FIG. 1 depicts an example setup of a conventional electrospinning system.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed examples, alone and in various combinations and sub-combinations with one another. The methods, apparatus, and systems are not limited to any specific aspect or feature or combination thereof, nor do the disclosed examples require that any one or more specific advantages be present or problems be solved. The technologies from any example can be combined with the technologies described in any one or more of the other examples. In view of the many possible examples to which the principles of the disclosed technology may be applied, it should be recognized that the illustrated examples are only preferred examples and should not be taken as limiting the scope of the disclosed technology.

Although the operations of some of the disclosed examples are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high-level abstractions of the actual operations that are performed. The actual operations that correspond to these terms may vary depending on the particular implementation and are readily discernible by one of ordinary skill in the art. Any theories of operation are to facilitate explanation, but the disclosed systems, methods, and apparatus are not limited to such theories of operation.

As used in this application and in the claims, the singular forms "a," "an," and "the" include the plural forms unless the context clearly dictates otherwise. Additionally, the term "includes" means "comprises." Further, the terms "coupled" and "connected" generally mean electrically, electromagnetically, and/or physically (e.g., mechanically or chemically) coupled or linked and does not exclude the presence of intermediate elements between the coupled or associated items absent specific contrary language.

In any of the examples described herein, the room temperature refers to a temperature in the range between 15° C. and 35° C., inclusive. In certain examples, the room temperature can be in the range between 20° C. and 30° C. (e.g., 25° C.). As described herein, the conventional solution electrospinning refers to non-heated solution electrospinning where the polymer solution is at or below the room temperature.

Directions and other relative references (e.g., inner, outer, upper, lower, etc.) may be used to facilitate discussion of the drawings and principles herein, but are not intended to be limiting. For example, certain terms may be used such as "inside," "outside," "interior," "exterior," and the like. Such terms are used, where applicable, to provide some clarity of description when dealing with relative relationships, particularly with respect to the illustrated examples. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

Overview of Electrospinning Technologies

Electrospinning is a method of producing micro- and nano-polymer fibers using high voltage. The most commonly used materials in electrospinning are organic polymers in the form of either solutions or melts. The polymers used for electrospinning can be organic polymers, including both natural and synthetic polymers, such as polycaprolactone (PCL), polylactic acid (PLA), poly(glycolic acid) (PGA), polydioxanone (PDO), polylactic-co-glycolic acid (PLGA), DNA, silk fibroin, fibrinogens, dextran, chitin, chitosan, alginate, collagen, gelatin, etc.

FIG. 1 depicts an example setup of a conventional electrospinning device, apparatus, or system 100, which can be used for both solution electrospinning and melt electrospinning. The electrospinning system 100 includes a high voltage power supply 102, a reservoir 104 which holds a liquid 120 of polymer solution or polymer melt, a nozzle 106 (also referred to as a spinneret or needle) in fluid communication with reservoir 104, a pump 108, and a collector 110. The pump 108 can be any devices configured to apply a pressure (which can be pneumatic or hydraulic) to the liquid 120 retained in the reservoir 104. For example, the reservoir 104 can be a barrel of a syringe and the pump 108 can be plunger of the syringe. Under the pressure of the pump 108, the liquid 120 in the reservoir 104 can flow into the nozzle 106, and then be extruded out of an orifice or opening 118 located at a distal tip of the nozzle 106 by the pump 108.

During electrospinning, the liquid 120 can be extruded from the nozzle 106 at a certain speed or flow rate under the control and propulsion of the pump 108. The extruded liquid 120 can initially form a pendant droplet with a spherical shape as a result of surface tension. The power supply 102 can apply a high voltage between the nozzle 106 and the collector 110. For example, the nozzle 106 can be positively charged and the collector 110 can be grounded, or vice versa. As another example, a differential voltage is applied between the nozzle 106 and the collector 110, while neither the nozzle 106 nor the collector 110 is grounded. The electrostatic repulsion of ions in the droplet under the high voltage can stretch the droplet from its initial spherical shape to a conical shape, also known as a Taylor cone 112. When the voltage exceeds a given threshold, the electric field force can overcome the surface tension of the droplet and cause a charged jet 114 to be ejected from the Taylor cone 112. The charged jet 114 initially extends in a straight line and then undergoes chaotic whipping motions because of bending instabilities (also known as whipping instability). As the charged jet 114 is stretched into finer diameters, it solidifies quickly, leading to the deposition and collection of solid fiber(s) 122 on a substrate 116 situated on the collector 110. The accumulation of the fiber(s) 122 on the substrate 116 can form a fiber mesh or fiber membrane/film.

In some examples, the electrospinning system 100 can include an array of nozzles, each of which can be used to extrude the liquid 120 and generate a charged jet. Such multi-nozzle configuration can be used to increase the fiber yield.

In solution electrospinning, the liquid 120 is formed, typically at room temperature, by dissolving a polymer of choice in a volatile solvent, such as dimethylformamide (DMF), dimethyl sulfoxide (DMSO), cyclohexanone, hexafluoroisopropanol (HFIP), trifluoroethanol (TFE), dichloromethane (DCM), chloroform (CHL), etc. As described herein, volatile solvents are liquids that can vaporize into a gas at the room temperature sufficiently rapidly so that fibers are formed. During the charged jetting process, polymer chain entanglements prevent the charged jet 114 from breaking into droplets (i.e., prevent electrospraying), while rapid evaporation of the solvent consolidates the charged jet into the fiber(s) 122. In some cases, residual solvent in the collected fiber(s) 122 can facilitate inter-fiber bonding that confers mechanical integrity to the resultant fiber mesh or membrane (or film).

In melt electrospinning, the liquid 120 is formed by heating a polymer of interest above its melting point so that the polymer becomes a polymer melt. Thus, unlike solution electrospinning, melt electrospinning eliminates the need for volatile solvents. During the charged jet jetting process, solidification of the polymer melt, e.g., under a cooling condition, can result in solidification of the fiber(s) 122 on the substrate 116. The degree of fiber cooling/solidification upon arrival to the collector 110 may control the degree of fusion between fibers 122.

Both solution and melt electrospinning technologies have their respective uses and limitations. For example, due to high viscosity of polymer melts, the fiber diameters obtained from melt electrospinning are usually larger than those obtained from solution electrospinning. This is because the diameter of the opening 118 of the nozzle 106 used for melt-electrospinning is larger compared to that for solution electrospinning, as the flow of high viscous polymer melt through a smaller diameter orifice can be challenging. For solution electrospinning, a thinner nozzle can concentrate the electric field more at the nozzle tip, thus causing more stretching and thinning of the fiber. However, for melt-electrospinning, a larger nozzle results in less concentrated electric field at the nozzle tip, thus making stretching and thinning of the fiber more challenging before the fiber solidifies.

For melt-electrospinning, the heating process itself can also pose challenges. For example, some polymers have very high melting points, which may be difficult to achieve in practical settings. Additionally, some polymers may degrade fast at such elevated temperatures. Further, because cooling is required for solidification of the polymer melt, the operating distance for the charged jet 114 to travel from the nozzle 106 to the substrate 116 is typically relatively large, e.g., about 15-20 cm. Such long operating distances can result in non-uniform thicknesses of the resultant fiber membranes or films as some quantity of fibers may fly away from (thus not collected on) the substrate 116 on the collector 110. Moreover, the large operating distance can complicate scaling up of electrospinning because the installation of multiple nozzles close to each other in a single setup may alter the electric field and jetting stability associated with each of the multiple nozzles, thus affecting the process and fiber quality.

On the other hand, solution electrospinning generally lacks reproducibility due to its sensitivity to multiple operational and environmental conditions. For example, the physical characteristics of the fibers (e.g., fiber diameter, porosity, etc.) produced by solution electrospinning are known to be influenced by the temperature and humidity of the environment due to their effects on rate of solvent vaporization and solution sensitivity to humidity.

For solution electrospinning, these environmental conditions can cause a polymer skin to be formed adjacent the opening 118 of the nozzle 106, which prevents stable jetting into thin fibers. The polymer skin may form due to a variety of reasons, such as local cooling of the polymer solution due to fast solvent evaporation, increased polymer concentration and viscosity on the droplet surface due to solvent evaporation, precipitation and phase separation of certain polymers when atmospheric water vapor is condensed on the droplet surface, etc. Consequently, fiber diameters and/or porosity of the resulting fiber membranes or films can lack homogeneity.

Further, the polymer skin can also clog the nozzle 106, necessitating pausing the electrospinning process for cleaning the nozzle. For example, when pausing the operation of solution electrospinning, the flow of polymer solution through the nozzle is typically stopped. The polymer solution at the nozzle tip can dry out and the polymer precipitate can form a polymer skin or a clog, which blocks or seals the nozzle tip. Once blocked, it can be challenging to unblock the nozzle tip, and typically it may require changing the nozzle for resuming the operation, which can result in a waste of time/material and prevent automation/scaleup. In some circumstances, the fiber membrane or film may also have local defects from residual solvent interfering with membrane formation.

Additionally, as in melt electrospinning, conventional solution electrospinning also has a large operating distance (e.g., about 15-20 cm) between the nozzle 106 and the substrate 116. Thus, the resulting fiber membrane or film also tends to have non-uniform thickness. Similarly, the large operating distance can complicate scaling up as placement of multiple nozzles close to each other can negatively affect electric field and jetting stability.

Many of the shortcomings of the conventional melt electrospinning and solution electrospinning can be overcome by the heated solution electrospinning technology described herein.

Example Heated Solution Electrospinning System

Figure 2:
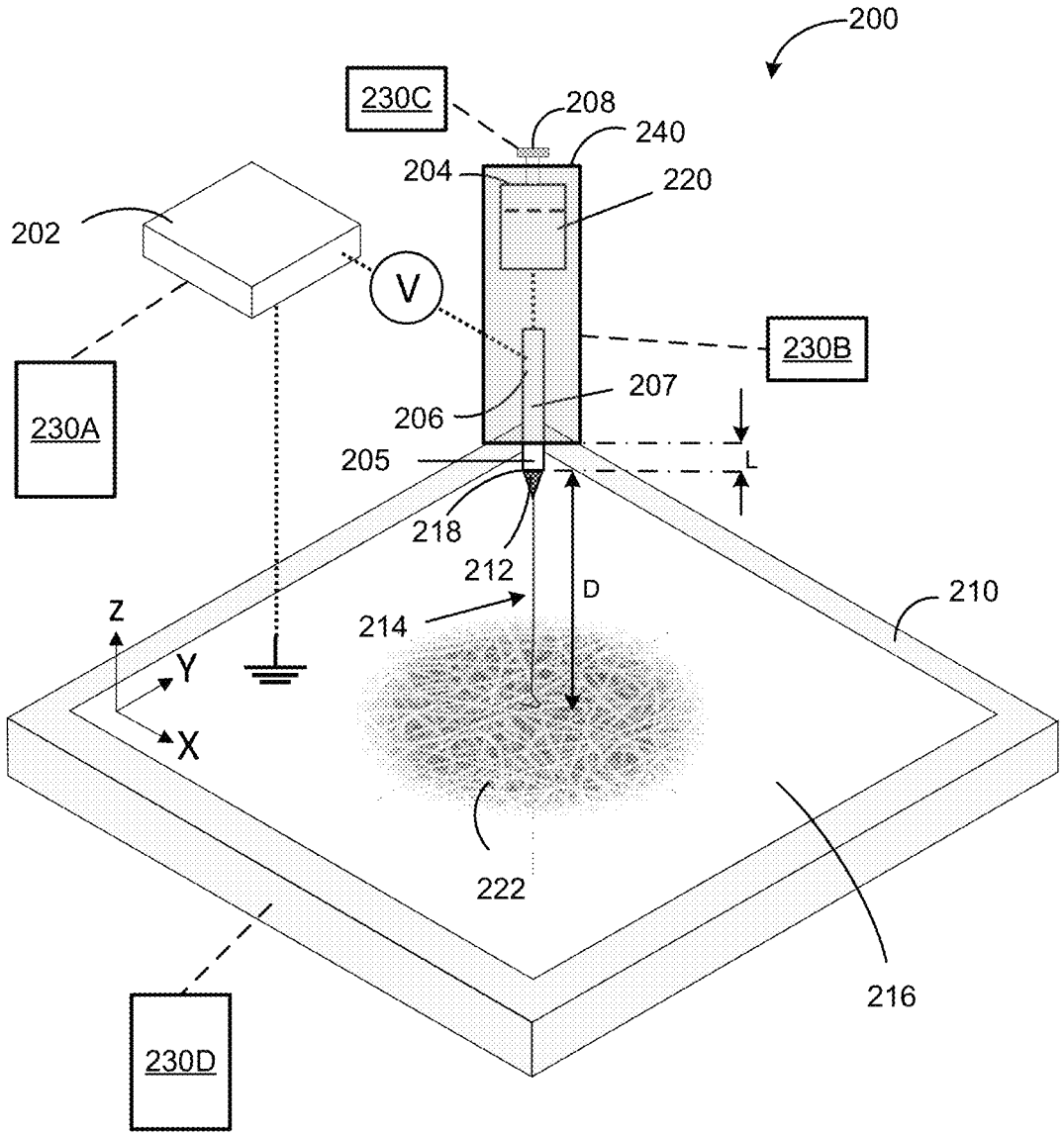
FIG. 2 depicts an example setup of a heated solution electrospinning system.

FIG. 2 depicts an example setup of a heated solution electrospinning device, apparatus, or system 200, according to certain aspects of disclosed technology. Similar to the system 100, the heated solution electrospinning system 200 includes a high voltage power supply 202, a reservoir 204 containing a polymer solution 220, a nozzle 206 configured to receive the polymer solution 220 from the reservoir 204, and a collector 210 configured to hold a substrate 216.

In some examples, the system can also include a pump 208 configured to pump the polymer solution 220 from the reservoir 204 into the nozzle 206, and further extrude the polymer solution 220 out of the nozzle 206. The pump 208 can be any devices configured to apply a hydraulic or pneumatic pressure to the polymer solution 220 contained in the reservoir 204. In some examples, the pump 208 can be connected to a pressure controller 230C, which is configured to apply a desired pressure to the pump 208 so as to extrude the polymer solution 220 through an orifice or opening 218 at a tip portion 205 of the nozzle 206. The applied pressure can be determined based on the size/length of the nozzle 206 and the viscosity of the polymer solution 220. In one specific example, when the polymer solution 220 includes 25-35 wt. % of PCL dissolved in DMF and a ¼-inch nozzle 206 of 32 gauge is used, the applied pressure can vary between 0.15 and 0.30 bar pressure.

As described herein, the polymer solution 220 can be formed by dissolving a polymer in a solvent. The polymer solution 220 can be heated to a higher temperature to increase the solubility and concentration of the dissolved polymer. As in solution electrospinning, the solvent used in heated solution electrospinning is volatile (i.e., the solvent can vaporize at the room temperature sufficiently rapidly so that fibers are formed). For example, the polymer used in the polymer solution 220 can be polycaprolactone and the corresponding solvent can be dimethylformamide. Other polymers and solvents can also be used. In some examples, the polymer solution 220 can include a small amount (e.g., up to 0.4-1 wt. %) of water. Water can be added to the polymer solution 220 through hydration of the pure solvent, and/or from air in contact with the polymer solution 220 as it exits the nozzle 206. Small amount of water content in the polymer solution 220 can change the conductivity of the polymer solution 220 and affect electrospinning quality.

The power supply 202 can be either direct current (DC) or alternating current (AC). Both the nozzle 206 (at least the tip portion 205) and the collector 210 can comprise conductive materials such as metals. For example, the nozzle 206 can comprise stainless steel or have a metal/conductive coating. The power supply 202 can apply a high voltage (also referred to as "accelerating voltage") between the nozzle 206 and the collector 210. The accelerating voltage can range from 5 kV to 50 kV, inclusive (e.g., about 15 kV in one specific example). In some examples, the nozzle 206 can be positively charged and the collector 210 can be grounded, or vice versa. In some examples, a differential voltage can be applied between the nozzle 206 and the collector 210, while neither the nozzle 206 nor the collector 210 is grounded.

In some examples, the power supply 202 can be connected to a voltage controller 230A which is configured to program and/or adjust the accelerating voltage, thereby generating an electrostatic field between the tip portion 205 of the nozzle and the substrate 216.

Similar to solution electrospinning, at a sufficient voltage differential between the tip portion 205 and the collector 210, the electrostatic force acting on the polymer solution 220 can overcome the surface tension and generate a Taylor cone 212 at the tip portion 205, from which a charged polymer jet 214 is drawn. Rapid evaporation of the solvent consolidates the polymer jet 214 into a fiber 222. Electrostatic repulsion and bending instability can cause chaotic whipping of the fiber 222, leading to fiber drawing and deposition on the substrate 216 with a random orientation.

As shown in FIG. 2, the heated solution electrospinning system 200 can further include a heating mechanism configured to maintain the polymer solution 220 in the nozzle 206 at a predetermined operating temperature. For example, the heating mechanism can be configured to heat the polymer solution 220 contained in both the reservoir 204 and the nozzle 206 to the operating temperature.

As described herein, the operating temperature for heated solution electrospinning is selected to be higher than the room temperature and lower than a boiling temperature of the solvent (thus, there is no boiling bubble of solvent at the operating temperature). In some examples, the operating temperature can be configured to be below a melting point of the polymer. For example, when the polymer comprises polycaprolactone (which has a melting point of 60° C.) and the solvent comprises dimethylformamide (which has a boiling point of 153° C.), the operating temperature can be set within a range between 40° C. and 100° C., inclusive. In some examples, the operating temperature can be set between 40° C. and 60° C., inclusive. In one specific example, the operating temperature can be set between 40° C. and 50° C., inclusive.

As described above, the polymer solution 220 can be prepared by dissolving the polymer of interest in a corresponding solvent. By heating the polymer solution 220, the viscosity of the polymer solution 220 can be reduced. Additionally, heating the polymer solution 220 allows the polymer to be dissolved at a higher concentration (e.g., compared to the polymer solutions used in conventional solution electrospinning). For example, heating the polymer solution 220 can allow the polymer concentration (measured in weight percentage, or wt. %) to be varied from few wt. % all the way up to 100 wt. % (e.g., as practiced in melt electrospinning). In one specific example, the polymer has a concentration between 10-50 wt. %, inclusive, in the polymer solution 220 at the operating temperature. Such polymer concentration ranges can be helpful as they allow substantial decreases in the viscosity of the heated polymer solution 220, which aids its thinning into nanoscale fibers, as described further below.

In the depicted example, the heating mechanism includes a heating container 240 which encloses the reservoir 204 and a body portion 207 of the nozzle 206. The temperature inside the heating container 240 can be adjusted so as to heat the polymer solution 220 inside the reservoir 204 and the nozzle 206 to the operating temperature. In one example, heating of the polymer solution 220 can be achieved via conductive coupling to the reservoir 204 and/or the nozzle 206 (e.g., when the reservoir 204 and/or the nozzle 206 are made of heat conductive materials). In other examples, heating of the polymer solution 220 can be achieved by other heat transfer mechanisms, such as convection or radiation.

In other examples, the heating mechanism can be configured to limit the heating to the polymer solution 220 contained in the nozzle 206. For example, the heating container 240 can be configured to enclose the nozzle 206 but not the reservoir 204. In such cases, the unheated polymer solution in the reservoir 204 can be heated to the operating temperature when received in the nozzle 206.

In some examples, the heating mechanism can be configured to maintain the polymer solution 220 at the operating temperature (T) by using a PID (i.e., proportional, integral, and derivative) temperature control mechanism. For example, a thermostat or other types of temperature sensors can be configured to measure the temperature of the polymer solution 220 and a heat controller 230B can be configured to control the heating container 240 to ensure the temperature of the polymer solution 220 remains as close as possible to the operating temperature (T).

In some examples, the heating mechanism can be configured to vary the operating temperature (T) within a predefined temperature range (e.g., between 40° C. and 60° C., etc.) of during the electrospinning process so as to change the evaporation rate of the solvent. Generally, increasing the operating temperature can increase the evaporate rate of the solvent, and vice versa. Variation of the operating temperature can be linear or nonlinear. In some examples, the pattern of operating temperature variation during the electrospinning process can be user defined. Changing the evaporation rate of the solvent can affect the properties of the produced fibers. For example, slower solvent evaporation allows the polymer solution to stretch and solidify more gradually, leading to thinner and more uniform fibers, whereas faster evaporation can result in thicker fibers and irregular morphologies due to rapid solidification. Slower evaporation can also result in a more porous structure than faster evaporation. Further, controlled evaporation helps maintain certain concentration gradients in the spinning solution, leading to desired fiber properties. Additionally, varying the operating temperature can affect fiber cooling/solidification, thereby controlling degree of fusion between fibers. Thus, by varying the operating temperature while electrospinning the polymer solution, the heated solution electrospinning system 200 can tweak solvent evaporation and fiber solidification dynamics without the need of changing composition of the polymer solution (e.g., using different solvent mixtures, etc.), as typically used in conventional solution electrospinning systems.

As shown in FIG. 2, the tip portion 205 of the nozzle can extend out of the heating container 240. The axial length (L) of the tip portion 205 extending out of the heating container 240 is desirably within a predefined range. On one hand, the axial length (L) of the tip portion 205 is configured to be sufficiently small so as to reduce the temperature drop when the heated polymer solution 220 moves out of the body portion 207 and passes through the tip portion 205. On the other hand, the axial length (L) of the tip portion 205 is configured to be sufficiently large so as to ensure field lines of the electrostatic field between the tip portion 205 and the collector 210 (or substrate 216) has a desired density and uniformity. In certain examples, the axial length (L) of the tip portion 205 is between 0.5 mm and 3 mm, inclusive (e.g., 2 mm).

As described above, heating can reduce the viscosity of the polymer solution 220, thus allowing the heated polymer solution to flow through a very small opening 218 of the nozzle, thereby producing very small diameters of the resulting fibers. For example, the opening 218 of the nozzle can have a sufficiently small inner diameter so as to reduce the diameter of the ejected polymer jet 214, thus ensuring the resulting fibers 222 have a small diameter (e.g., in the nanometer scale). In certain examples, the opening 218 of the nozzle has an inner diameter between 50 μm and 1 mm, inclusive. In one specific example, the tip portion 205 can be a 32-gauge needle with an opening diameter about 108 μm. In some examples, the diameters of the resulting PCL fibers 222 can range between 100 nm and 1000 nm, inclusive. In one specific example, the diameters of the resulting PCL fibers 222 can range between 100 nm and 400 nm, inclusive.

Under the electrostatic field, the charged polymer jet 214 can be drawn toward the substrate 216 situated at an operating distance (D) from the tip portion 205 of the nozzle. As described above, the fiber 222 can be formed from the charged polymer jet 214 after evaporation of at least some of the solvent and collected on the substrate 216. In some circumstances, residual solvent in the collected fibers 222 can facilitate inter-fiber bonding to form a fiber mesh or fiber membrane (or fiber film). The increased polymer concentration in the heated polymer solution 220 can also reduce or even eliminate whipping instability, presumably due to the fact that as the polymer solution cools down (e.g., to room temperature or below), the solution is already viscous enough to prevent breaking of the charged polymer jet 214 or reflow of fibers after deposition. Higher concentration of dissolved polymer also allows the polymer solution 220 to have less solvent, which can also improve robustness of fiber forming process.

As described above, one problem associated with conventional solution electrospinning is the formation of a polymer skin adjacent the opening of the nozzle, which can prevent stable jetting into thin fibers. However, one unexpected and surprising benefit of the heated solution electrospinning technology described herein is that the formation of polymer skin near the opening 218 of the nozzle 206 can be avoided. It is hypothesized that the heating can eliminate the formation of polymer skin by mitigating the local cooling effect of the polymer solution 220 (due to fast solvent evaporation), and/or by reducing the viscosity of the polymer solution 220.

Eliminating the skin formation near the opening 218 of the nozzle can have a number of advantages. For example, the absence of the skin surrounding the nozzle opening can cause less disturbance to the charged polymer jet 214. As a result, fiber diameter and/or porosity of the resulting fiber membrane or fiber film can be more homogeneous. For instance, one experiment shows that the resulting fiber membrane or fiber film (formed by fibers having a diameter between 100 nm and 400 nm) can have a porosity about 50-90% with pore sizes of less than 2 μm. Additionally, the absence of skin formation can also reduce or eliminate the risk of clogging of the opening 218, thus enabling continuous operation of the electrospinning without the need of intermittent pauses (to clean the nozzle).

In some examples, the heated solution electrospinning system 200 can be used to unclog the nozzle 206 if the nozzle 206, for whatever reason, is at least partially clogged by a polymer precipitate. For example, the nozzle 206 may be previously used for electrospinning a polymer solution (which can be the same polymer solution 220 used for heated electrospinning or another polymer solution containing a different polymer used for conventional solution electrospinning). After temporarily pausing the electrospinning, the polymer solution at the tip portion 205 can dry out (e.g., due to evaporation of the solvent) and the polymer in the polymer solution can precipitate and partially/fully clog the nozzle 206. To unclog the nozzle 206, the nozzle 206 can be heated (e.g., by the heating container 240 or another heating apparatus outside the system 200), at least temporarily, to a melting temperature that is above the melting point of the polymer forming the polymer precipitate. As a result, the polymer precipitate can be melted to become a polymer melt, which can be pressured or flushed out of the nozzle 206 through the opening 218 (e.g., by applying a pressure through the pump 208). After the nozzle 206 is unclogged, it can be reused for heated or conventional solution electrospinning. For example, the heating container 240 can maintain the nozzle 206 at the operating temperature (e.g., between 40° C. and 100° C., inclusive) while electrospinning the polymer solution. The operating temperature can be less than, equal to, or greater than the melting temperature used for unclogging the nozzle.

Moreover, the heated solution electrospinning system 200 allows evaporation of the solvent and deposition of the fiber over a shorter operating distance (D). Specifically, higher temperature of the polymer solution 220 and the resulting higher concentration of dissolved polymer can reduce the initial amount of solvent in the polymer solution, cause faster solvent evaporation and faster increase of polymer viscosity as it quickly cools. As a result, the heated solution electrospinning described herein can lead to faster fiber solidification and reduction of operating distance compared to conventional solution electrospinning technologies.

In any of the examples described herein, the operating distance (D) for the heated solution electrospinning can be significantly smaller than the operating distance achievable by the conventional solution electrospinning. For example, the operating distance for the system 100 of FIG. 1 is typically in a range between about 10-20 cm. In contrast, the operating distance (D) for the heated solution electrospinning as depicted in FIG. 2 can be less than 30 mm. For example, the operating distance (D) in heated solution electrospinning can be reduced to 5 mm, or even as short as 1 mm. In one specific example, the operating distance (D) is between 10 mm and 20 mm, inclusive. As a result, the collection of the fibers 222 on the substrate 216 can be very focused, e.g., the fibers 222 can be deposited in a localized spot about 1 mm-10 mm in diameter on the substrate 216).

One unexpected and surprising benefit of reduced operating distance (D) is the improved robustness of the electrospinning process against changing operational and/or environmental conditions. As described above, conventional solution electrospinning is sensitive to changes in operational conditions (e.g., accelerating voltage, pump pressure, etc.) and/or environmental conditions (e.g., temperature and/or humidity of the media between the nozzle and the collector, etc.). In contrast, the reduced operating distance (D) for the heated solution electrospinning can significantly improve the reproducibility and uniformity (e.g., in terms of fiber diameter, porosity, etc.) of the resulting fiber membranes or fiber films, presumably due to higher electric field gradient at a given accelerating voltage. For example, test results show that, when D is between 10 mm and 20 mm, changing the applied voltage from 10 kV to 20 kV or varying the environmental temperature by as much as 10° C. has negligible effect on physical characteristics of the resulting fibers. Experimental results also show that flow rate can be varied in a relatively broad range (factor of >2), e.g., by applying between 0.15-0.3 bar pneumatic pressure to the polymer solution, without causing detrimental effect on the quality of the produced fibers. Additionally, the heated solution electrospinning is less sensitive to ambient humidity than conventional solution electrospinning, presumably due to the fact that relative humidity (RH) drops quickly as the ambient air is heated in the vicinity of the nozzle and jet, resulting in both lower humidity and reduced humidity variation (e.g., when the ambient temperature is at 20° C. and the humidity is varied from 30% to 80% RH, the same air heated to 40° C. would have only 5-15% RH variation).

In some examples, the collector 210 (and the substrate 216 retained thereon) and the nozzle 206 can be configured to be movable relative to one another. In one example, the nozzle 206 can be stationary whereas the collector 210 can be motorized and its movement can be controlled by a motion controller 230D. In another example, the collector 210 can be stationary whereas the nozzle 206 can be configured to be movable (e.g., under the control of a motion controller similar to 230D) relative to the collector 210. The relative movement between the collector 210 and the nozzle 206 can be multi-directional. In one example, the collector 210 can be translated in an X-Y plane that is perpendicular to the longitudinal axis (or Z-axis) of the nozzle 206. In another example, the collector 210 can be moved along the Z-axis (e.g., moving closer to or farther away from the opening 218 of the nozzle 206). In yet additional examples, the collector 210 can be configured to rotate (e.g., in the X-Y plane) relative to the nozzle 206.

The controlled movement of the collector 210 and/or the nozzle 206 allows the fibers 222 to be deposited onto the substrate 216 into homogenous fiber membranes or films (e.g., with consistent fiber diameters, porosity, and/or pore sizes) of desired sizes.

In some examples, the electrical properties of the substrate 216 can be varied to impart specific properties on the fiber membranes of films deposited thereon. The electrical properties of the substrate 216 can directly affect the quality of the collected fibers 222 due to the difference of electrical charge accumulation or relaxation of the fibers 222 upon deposition. For example, the substrate 216 on which the fibers 222 are collected can comprise an electrically insulating material (e.g., glass, plastic, etc.), an electrically semiconductive material (e.g., silicon wafer, etc.), and/or an electrically conductive material (e.g., metals such as aluminum, aluminum foil, stainless steel, etc., or conductive polymers). In some examples, different parts of the substrate 216 can comprise different materials so as to allow local control on electrospun membrane.

Figure 3:
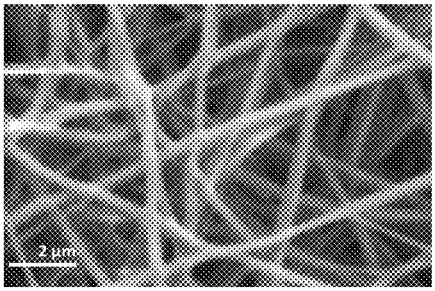
FIG. 3 depicts scanning electron microscope (SEM) images of two example fiber membranes formed by varying substrate material.
Figure 3:
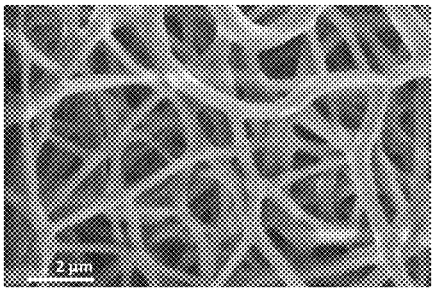

Thus, by varying the electrical properties of the substrate 216, the same operational conditions of electrospinning may lead to different membrane properties. For example, FIG. 3 shows SEM images (magnification 1000×) of two different fiber membranes 310, 320 formed when the substrate 216 comprises a glass and a metal, respectively. As shown, when electrospinning on glass, thinner and more straight fibers can be obtained, and the fiber fusion can be reduced. As a result, the membrane 310 has a higher membrane porosity and a larger average pore size (compared to the membrane 320). However, at the same operating conditions but when electrospinning on metal, the collected fibers can have a larger diameter and be more wavy. Additionally, the fibers can arrive the substrate less solidified and thus have more inter-fiber fusion. As a result, the membrane 320 has a lower porosity and smaller average pore size (compared to the membrane 310), suggesting better barrier properties. Thus, the selection of the substrate material can be used to further optimize the membrane properties for specific applications.

In some examples, the formed fiber membranes or films can have uniform or varied thickness. Specifically, local thickness of the fiber membrane can be controlled by varying or adjusting translation path of the collector 210 or substrate 216 while electrospinning the heated polymer solution. In some examples, the thickness of the formed fiber membranes can vary from a few hundred nanometers to tens of micrometers or more, depending on the number of programmed deposition passes over the same location.

Figure 4:
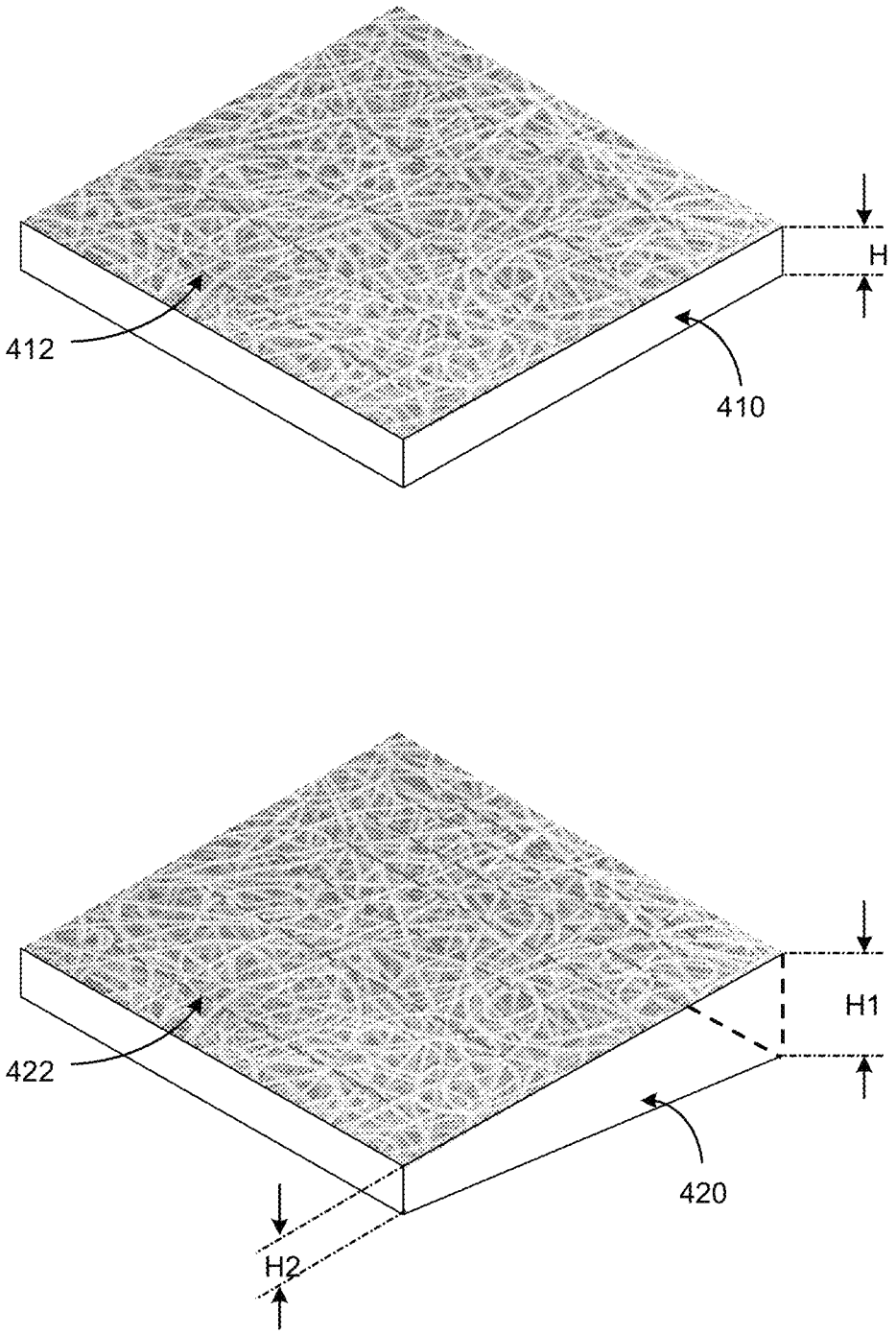
FIG. 4 depicts examples of varying translation path of a substrate to control local thickness of membranes fabricated using a heated solution electrospinning system.

To illustrate, FIG. 4 schematically depicts two example membranes 410, 420 that can be fabricated using the heated solution electrospinning system 200. The membrane 410 is produced when translation of the substrate relative to the nozzle causes the polymer jet to deposit along a plurality of parallel deposition lines 412 with uniform spacing. The resulting membrane 410 has a uniform thickness (H) because the same amount of fiber is formed across the deposition lines 412. In contrast, the membrane 420 is produced when translation of the substrate relative to the nozzle causes the polymer jet to deposit along a plurality of parallel deposition lines 422 with progressively reduced spacing. The thickness of the resulting membrane 420 progressively increases from H2 to H1 because more fiber is locally formed as the density of deposition lines 422 increases.

Thus, by allowing relative movement between the collector 210 and the nozzle 206, the heated solution electrospinning system 200 can be used to 3D print polymer structures (e.g., by controlling the membrane thickness locally and/or introducing gradients of thickness of the structures). As an example, one test shows that one nozzle can deposit a fiber membrane of 25 mm×25 mm in planar size and 10 μm of thickness with nanofibers of 150 nm or 300 nm in diameter in about 10-15 minutes.

Additionally, the speed and pattern of motion of the collector 210 relative to the nozzle 206 can affect the fiber properties and deposition spot size. For example, faster motion of the collector 210 can result in smaller spot size, presumably due to less charge accumulation on the collector 210 when faster passes are made, thus causing less fiber repulsion and narrower deposition spot (e.g., less fiber repulsion allows fibers to land closer to the original jet trajectory).

Moreover, the smaller operating distance (D) also allows the usage of an array of nozzles to increase the throughput efficiency. In conventional solution electrospinning, placement of multiple nozzles close to each other can negatively affect jetting stability because the neighboring electrostatic fields can interfere with each other over a relatively long operating distance. By reducing the operating distance (D), a plurality of nozzles (similar to 206) can be used simultaneously for electrospinning of heated polymer solution because the likelihood of interference between neighboring electrostatic fields is reduced by confining the electrostatic field within the smaller gap between the nozzles and the substrate. The plurality of nozzles can be arranged in one dimensional (e.g., along X or Y axis) or in two dimensional (e.g., in both X and Y axes). The nozzle spacing, i.e., the distance between two adjacent nozzles, can be between 50% and 250%, inclusive, of the operating distance (D). For example, the smallest nozzle spacing can be about 5 mm for D=10 mm, or 10 mm for D=20 mm. In one specific example, when the operating distance (D) is varied from 10 mm to 20 mm, the nozzle spacing between array of nozzles can be set to 25 mm without observable interference between neighboring electrostatic fields.

Straight jet with no or minimal whipping along its trajectory is a distinctive feature of the disclosed heated electrospinning compared to standard (non-heated) solution electrospinning. Experimental results shows that whipping might be observed very locally just above the collector (e.g., 1 mm or less). This local whipping is arguably due to accumulated charges on collector. This straight jet trajectory suggests that spacing could be significantly reduced without jet interference compared with the nozzle spacing used.

When multiple nozzles are used, the polymer solution feeding each nozzle can be provided by the same reservoir (e.g., 204) or multiple reservoirs (e.g., each nozzle can receive the polymer solution from a designated reservoir). In some examples, all nozzles and/or reservoirs can share and be heated by the same heating container (e.g., 240). Alternatively, each nozzle and the corresponding reservoir can be enclosed within a corresponding heating container.

Figure 5:
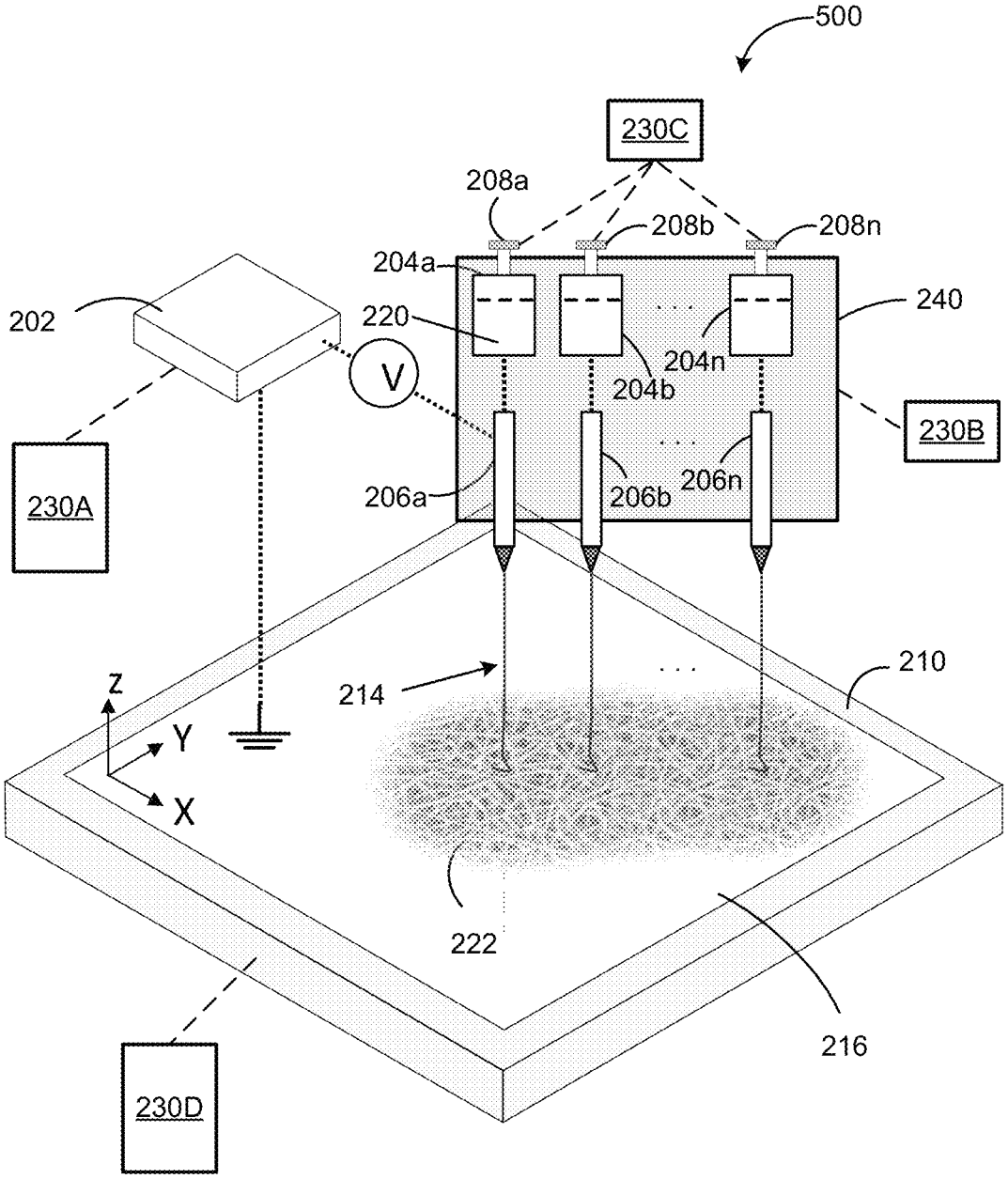
FIG. 5 depicts an example heated solution electrospinning system including multiple nozzles.

As an example, FIG. 5 schematically depicts a heated solution electrospinning system 500 including multiple nozzles. As shown, the heating container 240 can enclose and heat multiple reservoirs 204*a*, 204*b*, . . . , 204*n*, which are in fluid communication with respective nozzles 206*a*, 206*b*, . . . , 206*n*. The polymer solution 220 in each reservoir can be individually pressurized by respective pumps 208*a*, 208*b*, . . . , 208*n* to control the flow rate. In the depicted example, the pressure controller 230C is configured to apply equal pressure to all pumps 208. In other examples, different pressure control can be applied to different pumps.

Although FIGS. 2 and 5 shows multiple controllers (e.g., 230A, 230B, 230C, and 230D), it should be understood that any number of the depicted controllers can be integrated within one controlling module. For example, a unitary controller can be configured to control the applied voltage between the nozzle 206 and the collector 210, the pressure applied to the pump 208, the operating temperature of the heating container 240, and/or the relative movement between the collector 210 and the nozzle 206.

Example Methods for Heated Solution Electrospinning

Figure 6:
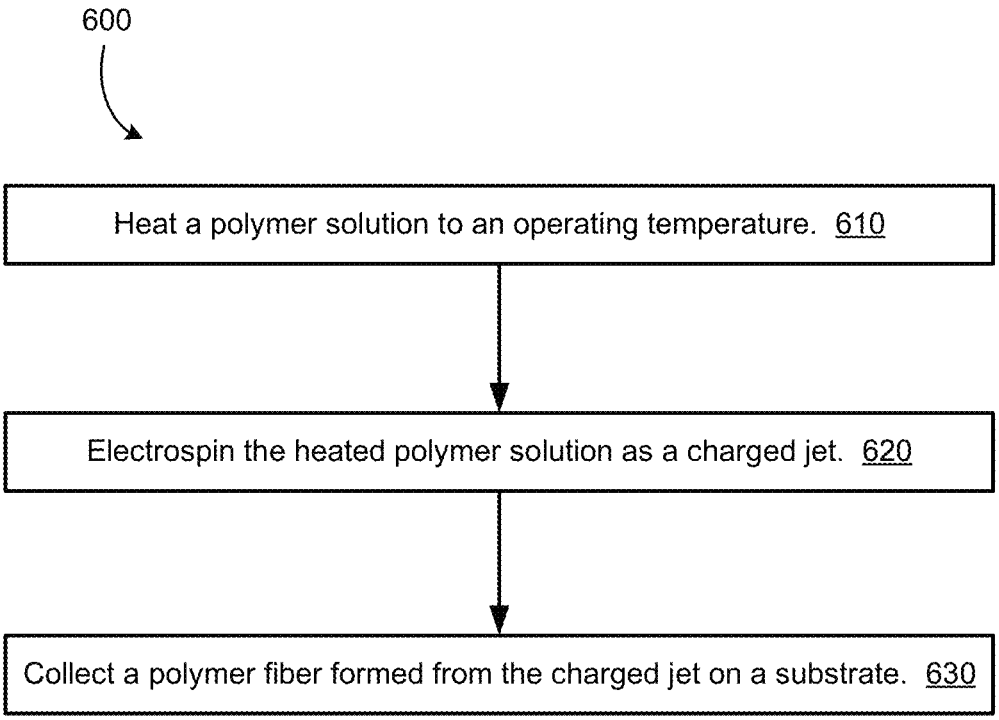
FIG. 6 is a flowchart depicting a method of producing fibers using heated solution electrospinning technology, according to one example.

FIG. 6 is a flowchart describing an overall method 600 for heated solution electrospinning, which can be performed, for example, by using the heated solution electrospinning system 200 of FIG. 2.

At 610, a polymer solution can be heated to an operating temperature. The operating temperature can be greater than or equal to 40° C. The polymer solution includes a polymer dissolved in a solvent at the operating temperature.

At 620, the heated polymer solution can be electrospun as a charged jet escaping from a nozzle, e.g., under an electrostatic field established between the nozzle and a substrate.

At 630, a polymer fiber can be collected on the substrate. The polymer fiber can be formed from the charged jet after evaporation of at least some of the solvent.

Figure 7:
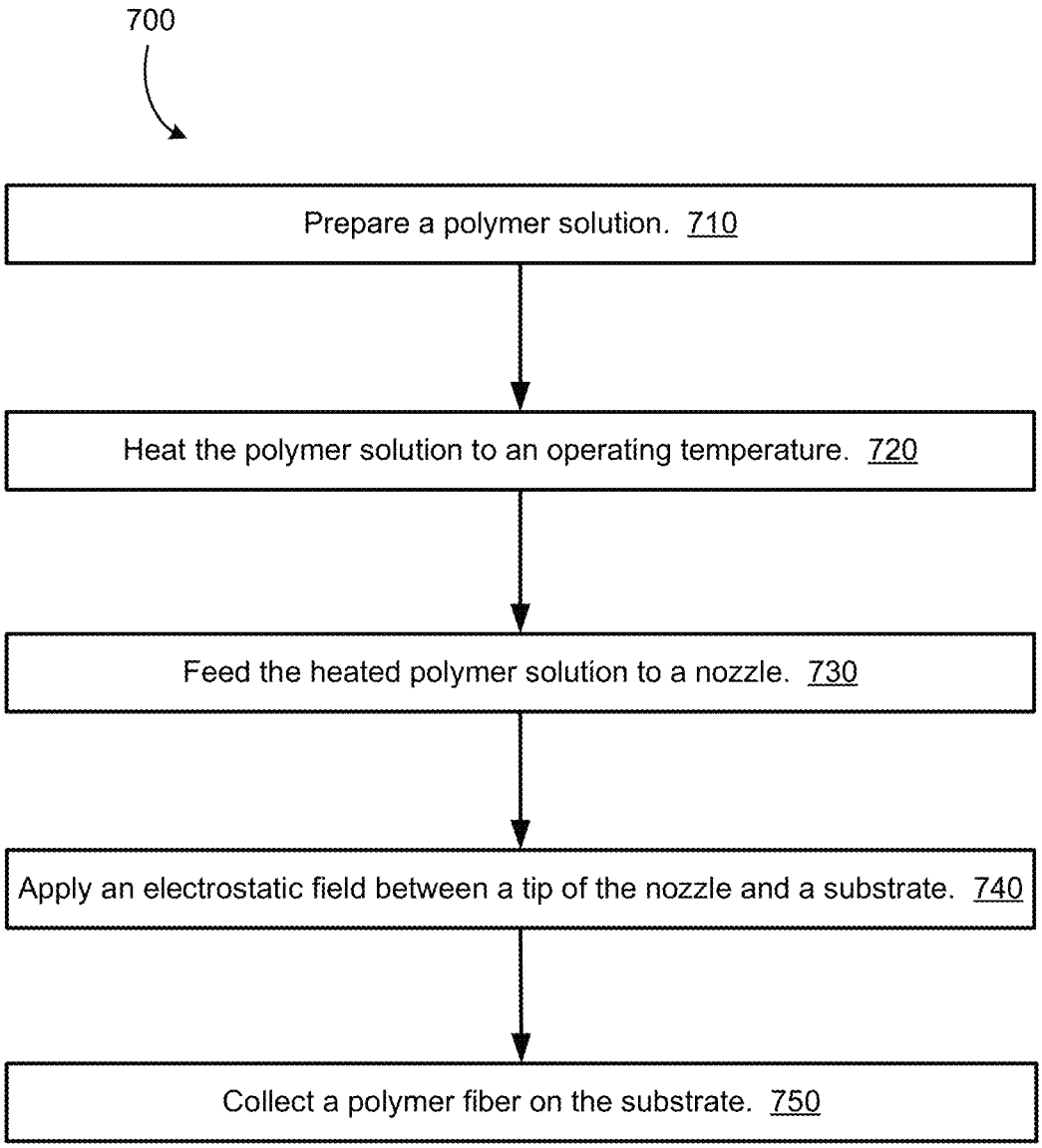
FIG. 7 is a flowchart depicting a method of producing fibers using heated solution electrospinning technology, according to another example.

FIG. 7 is a flowchart depicting a specific example method 700 for heated solution electrospinning.

At 710, a polymer solution including PCL dissolved in DMF is prepared.

At 720, the polymer solution can be heated to an operating temperature that is between 40° C. and 100° C.

At 730, the heated polymer solution can be fed to a nozzle.

At 740, an electrostatic field between a tip portion of the nozzle and a substrate spaced apart from the tip portion of the nozzle can be applied. The electrostatic field is configured to draw a charged jet of the polymer solution out of the tip portion of the nozzle toward the substrate.

At 750, a fiber can be collected on the substrate. The fiber is formed from the charged jet after evaporation of at least some of the DMF.

Figure 8:
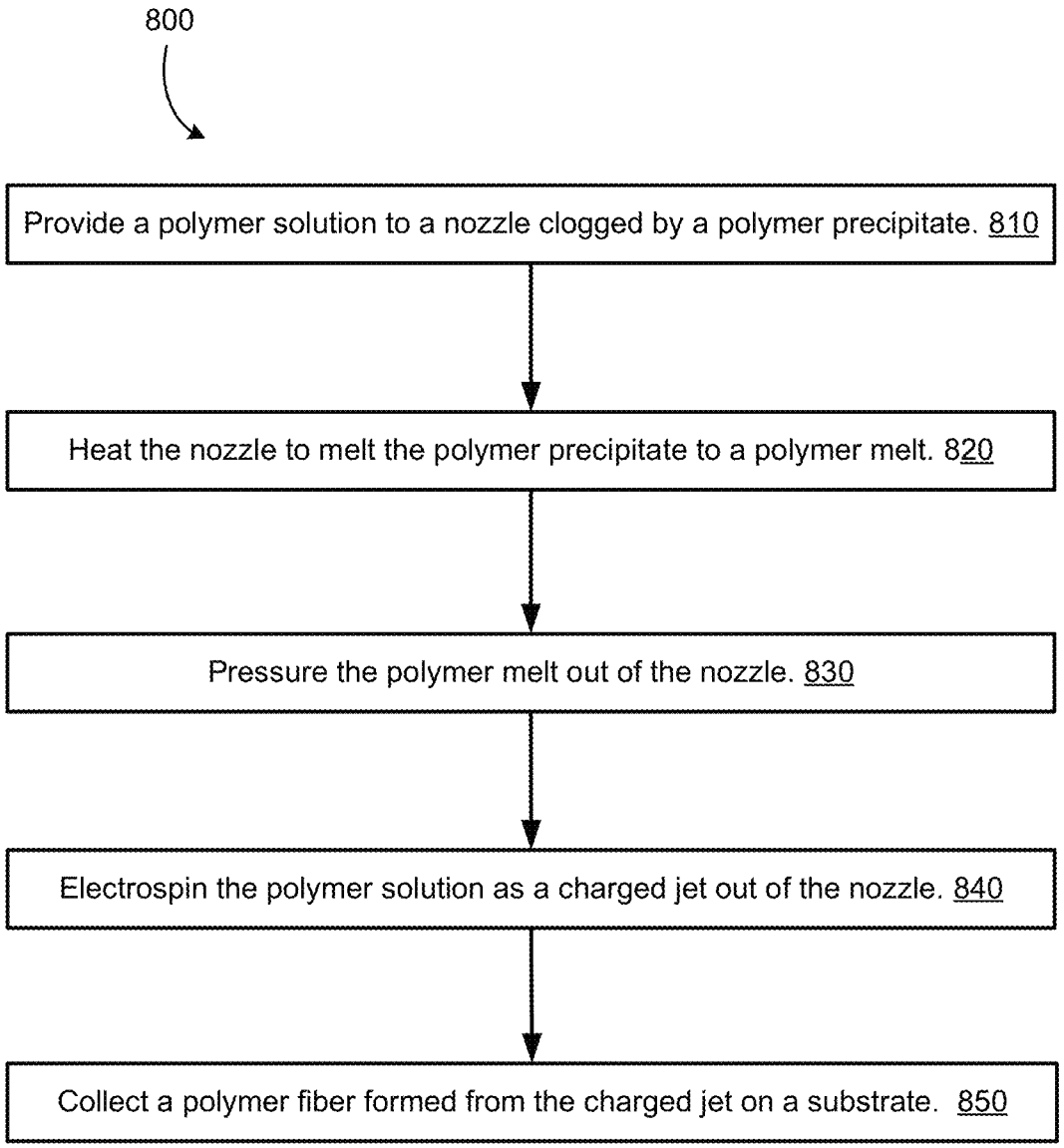
FIG. 8 is a flowchart depicting a method of unclogging a nozzle, according to one example.

FIG. 8 is a flowchart depicting an example method 800 for unclogging a nozzle.

At 810, a polymer solution is provided to a nozzle which is at least partially blocked by a polymer precipitate. For example, the polymer solution can contain a polymer dissolved in a solvent. The nozzle can be previously used for electrospinning the polymer solution. After temporarily pausing the electrospinning, the solvent may evaporate, and the polymer can precipitate and clog the opening.

At 820, the nozzle can be heated (at least temporarily) to a melting temperature (e.g., above the melting point of the polymer) that is sufficient to melt the polymer precipitate to a polymer melt.

At 830, the polymer melt can be pressured out of the nozzle through the opening so that the nozzle is unclogged.

At 840, the polymer solution can be electrospun as a charged jet escaping from the nozzle. At this step, the polymer solution can be maintained at an operating temperature (e.g., between 40° C. and 100° C., inclusive) while electrospinning the polymer solution.

At 850, a polymer fiber can be collected on a substrate. The polymer fiber can be formed from the charged jet after evaporation of at least some of a solvent in the polymer solution.

Example Operating Variables

The table below lists example ranges and specific examples of certain operating variables that can be used in heated solution electrospinning described herein.

| Variables | Example Ranges | Specific Example(s) |
|---|---|---|
| Polymer | Natural or synthetic organic polymers | PCL, PLA, PLGA, PDO, etc. |
| Solvent | Volatile solvent | DMF, HFIP, TFE, DMSO, etc. |
| Operating temperature (T) | Above room temperature and below boiling temperature of solvent | 40° C.-100° C. |
| Operating distance (D) | 5 mm-30 mm | 10 mm-20 mm |
| Applied voltage | 5 kV-50 kV | 10 kV-20 kV |
| Pump pressure | 0.05-1.00 bar | 0.15-0.30 bar |
| Tip portion length (L) | 0.5 mm-3 mm | 1-2 mm |
| Nozzle opening diameter | 50 μm-1 mm | 108 μm (32 gauge) |
| Fiber diameter | 100 nm-1000 nm | 100-200 nm, 200-400 nm |
| Fiber membrane porosity | 20%-95% | 70%-90% |
| Fiber membrane pore size | <5 μm | <2 μm |
| Environmental temperature | 15° C.-35° C. | 19° C.-22° C. |
| Environmental humidity | 0-100% RH | 20-40% RH |
| Solution concentration | 10-100 wt. % | 25-35 wt. % |
| Translation speed | 0.1-20 mm/s | 1-5 mm/s |

Example Advantages

A number of advantages can be achieved via the technologies described herein. As described above, conventional solution electrospinning generally lacks reproducibility due to its sensitivity to multiple operational and environmental conditions, whereas conventional melt electrospinning cannot produce thinner nanofibers that are achievable with solution electrospinning. Further, in both melt electrospinning and solution electrospinning, the relatively large operating distance can result in non-uniform thickness of the resultant fiber membrane or film and complicate scaling up of electrospinning by using multiple nozzles. The heated solution electrospinning technology described herein overcomes many of the above-mentioned disadvantages of the conventional melt and solution electrospinning technologies.

Specifically, by heating the polymer solution to a predefined operating temperature, the heated solution electrospinning can eliminate the skin formation near the opening of the nozzle and reduce the operating distance. Preventing skin formation can eliminate the need for regular cleansing and maintenance of the nozzle. Even with a previously clogged nozzle, the heating can automatically unclog the nozzle. Due to smaller operating distance, the resulting fibers can be uniformly thin (e.g., consistently between 100 nm and 300 nm in diameter) and precisely controlled. As a result, a number of unique advantages can be achieved. For example, the resulting fiber membrane or fiber film can have fewer defects, have homogenous fiber diameters, have consistent and/or controllable membrane thickness, and have controllable fusion between fibers (e.g., by varying operating temperature while electrospinning the polymer solution).

Importantly, this heated solution electrospinning approach can produce high-quality polymer membranes with improved consistency and process stability over a wide range of operating and/or environmental conditions, as described above. Improved process stability and reproducibility can positively impact the quality of the collected fibers and allows for the automation of this technique.

Further, the heated solution electrospinning system described herein is scalable by incorporating multiple nozzles (without affecting the stability of the electrospinning process). Automation of relative movement between the collector and the nozzle(s) can further convey additional advantages, such as controlling the membrane thickness locally and introducing gradients of thickness (e.g., by adjusting translation path of the collector while electrospinning the heated polymer solution), thereby allowing precise 3D printing of polymer structures.

Example Computing Systems

Figure 9:
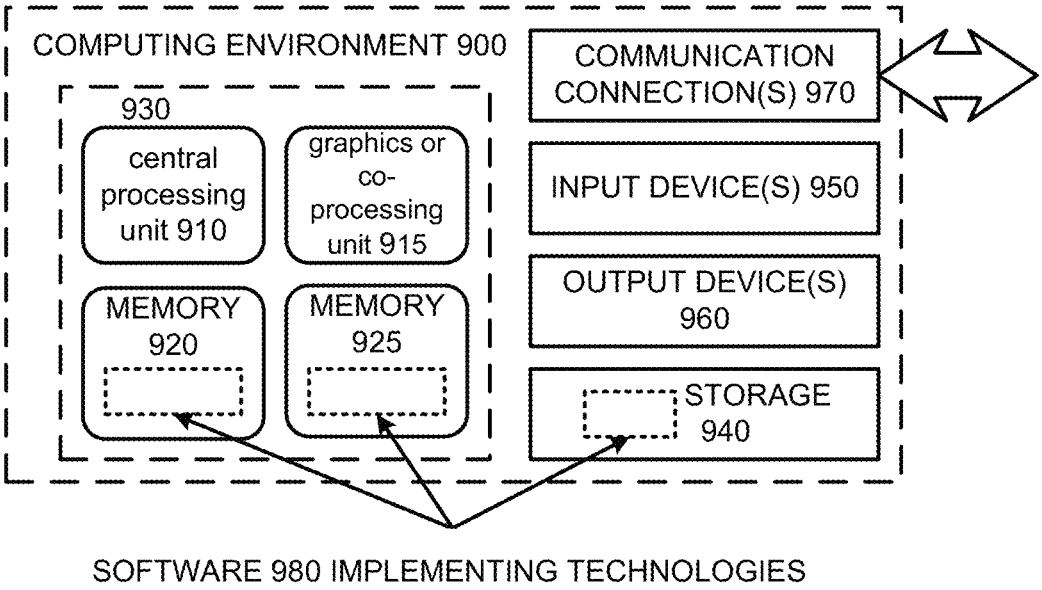
FIG. 9 is a block diagram of an example computing system in which described technologies can be implemented.

FIG. 9 depicts an example of a suitable computing system 900 in which the described innovations can be implemented. For example, the computing system 900 can be used in any of the controllers (e.g., 230A-230D) depicted in FIG. 2. The computing system 900 is not intended to suggest any limitation as to scope of use or functionality of the present disclosure, as the innovations can be implemented in diverse computing systems.

With reference to FIG. 9, the computing system 900 includes one or more processing units 910, 915 and memory 920, 925. In FIG. 9, this basic configuration 930 is included within a dashed line. The processing units 910, 915 execute computer-executable instructions, such as for implementing the features described in the examples herein. A processing unit can be a general-purpose central processing unit (CPU), processor in an application-specific integrated circuit (ASIC), or any other type of processor. In a multi-processing system, multiple processing units execute computer-executable instructions to increase processing power. For example, FIG. 9 shows a central processing unit 910 as well as a graphics processing unit or co-processing unit 915. The tangible memory 920, 925 can be volatile memory (e.g., registers, cache, RAM), non-volatile memory (e.g., ROM, EEPROM, flash memory, etc.), or some combination of the two, accessible by the processing unit(s) 910, 915. The memory 920, 925 stores software 980 implementing one or more innovations described herein, in the form of computer-executable instructions suitable for execution by the processing unit(s) 910, 915.

A computing system 900 can have additional features. For example, the computing system 900 includes storage 940, one or more input devices 950, one or more output devices 960, and one or more communication connections 970, including input devices, output devices, and communication connections for interacting with a user. An interconnection mechanism (not shown) such as a bus, controller, or network interconnects the components of the computing system 900. Typically, operating system software (not shown) provides an operating environment for other software executing in the computing system 900, and coordinates activities of the components of the computing system 900.

The tangible storage 940 can be removable or non-removable, and includes magnetic disks, magnetic tapes or cassettes, CD-ROMs, DVDs, or any other medium which can be used to store information in a non-transitory way and which can be accessed within the computing system 900. The storage 940 stores instructions for the software implementing one or more innovations described herein.

The input device(s) 950 can be an input device such as a keyboard, mouse, pen, or trackball, a voice input device, a scanning device, touch device (e.g., touchpad, display, or the like) or another device that provides input to the computing system 900. The output device(s) 960 can be a display, printer, speaker, CD-writer, or another device that provides output from the computing system 900.

The communication connection(s) 970 enable communication over a communication medium to another computing entity. The communication medium conveys information such as computer-executable instructions, audio or video input or output, or other data in a modulated data signal. A modulated data signal is a signal that has one or more of its characteristics set or changed in such a manner as to encode information in the signal. By way of example, and not limitation, communication media can use an electrical, optical, RF, or other carrier.

The innovations can be described in the context of computer-executable instructions, such as those included in program modules, being executed in a computing system on a target real or virtual processor (e.g., which is ultimately executed on one or more hardware processors). Generally, program modules or components include routines, programs, libraries, objects, classes, components, data structures, etc. that perform particular tasks or implement particular abstract data types. The functionality of the program modules can be combined or split between program modules as desired in various examples. Computer-executable instructions for program modules can be executed within a local or distributed computing system.

For the sake of presentation, the detailed description uses terms like "determine" and "use" to describe computer operations in a computing system. These terms are high-level descriptions for operations performed by a computer and should not be confused with acts performed by a human being. The actual computer operations corresponding to these terms vary depending on implementation.

Example Computer-Readable Media

Any of the computer-readable media herein can be non-transitory (e.g., volatile memory such as DRAM or SRAM, nonvolatile memory such as magnetic storage, can be implemented by storing in one or more computer-readable media (e.g., computer-readable storage media or other tangible media). Any of the things (e.g., data created and used during implementation) described as stored can be stored in one or more computer-readable media (e.g., computer-readable storage media or other tangible media). Computer-readable media can be limited to implementations not consisting of a signal.

Any of the methods described herein can be implemented by computer-executable instructions in (e.g., stored on, encoded on, or the like) one or more computer-readable media (e.g., computer-readable storage media or other tangible media) or one or more computer-readable storage devices (e.g., memory, magnetic storage, optical storage, or the like). Such instructions can cause a computing device to perform the method. The technologies described herein can be implemented in a variety of programming languages.

Example Clauses

Any of the following example clauses can be implemented.

Clause 1. A device comprising: a nozzle configured to receive a heated polymer solution from a reservoir; and a power supply configured to generate an electrostatic field between a tip portion of the nozzle and a substrate so as to draw a charged jet of the heated polymer solution out of the tip portion of the nozzle toward a substrate situated at an operating distance from the tip portion of the nozzle and form a polymer fiber on the substrate, wherein the heated polymer solution is at an operating temperature that is greater than or equal to 40° C.

Clause 2. The device of clause 1, further comprising a heating container situated to provide the heated polymer solution to the nozzle.

Clause 3. The device of clause 2, wherein the heating container encloses the reservoir and a body portion of the nozzle, wherein the tip portion of the nozzle extends out of the heating container.

Clause 4. The device of any one of clauses 2-3, wherein the tip portion of the nozzle extending out of the heating container has an axial length between 0.5 mm and 3 mm, inclusive.

Clause 5. The device of any one of clauses 2-4, wherein the heated polymer solution comprises a solvent and a polymer dissolved in the solvent, wherein the heating container is configured to maintain the heated polymer solution at the operating temperature, wherein the operating temperature is below a boiling temperature of the solvent.

Clause 6. The device of clause 5, wherein the operating temperature is below a melting point of the polymer.

Clause 7. The device of any one of clauses 5-6, wherein the polymer comprises polycaprolactone and the solvent comprises dimethylformamide, wherein the operating temperature is between 40° C. and 100° C., inclusive.

Clause 8. The device of any one of clauses 5-7, wherein the polymer has a concentration between 10-50 wt. %, inclusive, in the heated polymer solution at the operating temperature.

Clause 9. The device of any one of clauses 1-8, wherein the tip portion of the nozzle has an opening with an inner diameter between 50 μm and 1 mm, inclusive.

Clause 10. The device of any one of clauses 1-8, wherein the operating distance is between 5 mm and 30 mm, inclusive.

Clause 11. The device of any one of clauses 1-9, further comprising a collector configured to retain the substrate, wherein the collector is configured to move relative to the nozzle.

Clause 12. The device of any one of clauses 1-11, wherein the nozzle is one of a plurality of nozzles configured to receive the heated polymer solution which is electrospun into charged jets escaping from the plurality of nozzles to form respective polymer fibers on the substrate, wherein a distance between two adjacent nozzles is between 50% and 250%, inclusive, of the operating distance.

Clause 13. The device of any one of clauses 1-12, wherein the substrate comprises an electrically insulating material.

Clause 14. The device of any one of clauses 1-12, wherein the substrate comprises an electrically conductive material.

Clause 15. The device of any one of clauses 1-12, wherein the substrate comprises an electrically semiconductive material.

Clause 16. A method comprising: heating a polymer solution to an operating temperature that is greater than or equal to 40° C.; electrospinning the polymer solution as a charged jet escaping from a nozzle; and collecting a polymer fiber on a substrate, wherein the polymer solution comprising a polymer dissolved in a solvent at the operating temperature, wherein the polymer fiber is formed from the charged jet after evaporation of at least some of the solvent.

Clause 17. The method of clause 16, wherein heating the polymer solution comprises heating a reservoir and the nozzle containing the polymer solution.

Clause 18. The method of any one of clauses 16-17, wherein a distance between the nozzle and the substrate is between 5 mm and 30 mm, inclusive.

Clause 19. The method of any one of clauses 16-18, wherein the operating temperature is lower than a boiling temperature of the solvent.

Clause 20. The method of any one of clauses 16-19, wherein the polymer comprises polycaprolactone and the solvent comprises dimethylformamide.

Clause 21. The method of any one of clauses 16-20, wherein the electrospinning comprises creating an electrostatic field between the nozzle and the substrate.

Clause 22. The method of any one of clauses 16-21, further comprising varying the operating temperature of the polymer solution while electrospinning the polymer solution so as to change evaporation rate of the solvent.

Clause 23. The method of any one of clauses 16-22, wherein collecting the polymer fiber comprises moving the substrate relative to the nozzle.

Clause 24. The method of clause 23, wherein moving the substrate relative to the nozzle comprises varying translation path of the substrate while electrospinning the polymer solution so as to adjust thickness of a membrane formed by the polymer fiber collected on the substrate.

Clause 25. A method comprising: preparing a polymer solution comprising polycaprolactone dissolved in dimethylformamide; heating the polymer solution to an operating temperature that is between 40° C. and 100° C., inclusive; feeding the polymer solution to a nozzle; applying an electrostatic field between a tip portion of the nozzle and a substrate spaced apart from the tip portion of the nozzle, wherein the electrostatic field is configured to draw a charged jet of the polymer solution out of the tip portion of the nozzle toward the substrate; and collecting a fiber on the substrate, wherein the fiber is formed from the charged jet after evaporation of at least some of the dimethylformamide.

Clause 26. A method comprising: providing a polymer solution to a nozzle, wherein an opening of the nozzle is clogged by a polymer precipitate; heating the nozzle to a melting temperature that is sufficient to melt the polymer precipitate to a polymer melt; pressuring the polymer melt out of the nozzle through the opening so that the nozzle is unclogged; electrospinning the polymer solution as a charged jet escaping from the nozzle; and collecting a polymer fiber on a substrate, wherein the polymer fiber is formed from the charged jet after evaporation of at least some of a solvent in the polymer solution.

Clause 27. The method of clause 26, wherein the polymer solution comprises a polymer dissolved in the solvent, the method further comprising maintaining the polymer solution to an operating temperature that is between 40° C. and 100° C., inclusive, while electrospinning the polymer solution.

Example Alternatives

The technologies from any example can be combined with the technologies described in any one or more of the other examples. In view of the many possible examples to which the principles of the disclosed technology can be applied, it should be recognized that the illustrated embodiments are examples of the disclosed technology and should not be taken as a limitation on the scope of the disclosed technology. Rather, the scope of the claimed subject matter is defined by the following claims and their equivalents.

We claim:

1. A device comprising:

a nozzle configured to receive a heated polymer solution from a reservoir; and a power supply configured to generate an electrostatic field between a tip portion of the nozzle and a substrate so as to draw a charged jet of the heated polymer solution out of the tip portion of the nozzle toward a substrate situated at an operating distance from the tip portion of the nozzle and form a polymer fiber on the substrate, wherein the heated polymer solution is at an operating temperature that is greater than or equal to 40° C., wherein the nozzle is one of a plurality of nozzles configured to receive the heated polymer solution which is electrospun into charged jets escaping from the plurality of nozzles to form respective polymer fibers on the substrate, wherein a distance between two adjacent nozzles is between 50% and 250%, inclusive, of the operating distance.

2. The device of claim 1, further comprising a heating container situated to provide the heated polymer solution to the nozzle.

3. The device of claim 2, wherein the heating container encloses the reservoir and a body portion of the nozzle, wherein the tip portion of the nozzle extends out of the heating container.

4. The device of claim 2, wherein the tip portion of the nozzle extending out of the heating container has an axial length between 0.5 mm and 3 mm, inclusive.

5. The device of claim 2, wherein the heated polymer solution comprises a solvent and a polymer dissolved in the solvent, wherein the heating container is configured to maintain the heated polymer solution at the operating temperature, wherein the operating temperature is below a boiling temperature of the solvent.

6. The device of claim 5, wherein the operating temperature is below a melting point of the polymer.

7. The device of claim 5, wherein the polymer comprises polycaprolactone and the solvent comprises dimethylformamide, wherein the operating temperature is between 40° C. and 100° C., inclusive.

8. The device of claim 5, wherein the polymer has a concentration between 10-50 wt. %, inclusive, in the heated polymer solution at the operating temperature.

9. The device of claim 1, wherein the tip portion of the nozzle has an opening with an inner diameter between 50 μm and 1 mm, inclusive.

10. The device of claim 1, wherein the operating distance is between 5 mm and 30 mm, inclusive.

11. A method comprising:

heating a polymer solution to an operating temperature that is greater than or equal to 40° C.;

electrospinning the polymer solution as a charged jet escaping from a nozzle; and collecting a polymer fiber on a substrate situated at an operating distance from a tip portion of the nozzle, wherein the polymer solution comprising a polymer dissolved in a solvent at the operating temperature, wherein the polymer fiber is formed from the charged jet after evaporation of at least some of the solvent, wherein the nozzle is one of a plurality of nozzles configured to receive the heated polymer solution which is electrospun into charged jets escaping from the plurality of nozzles to form respective polymer fibers on the substrate, wherein a distance between two adjacent nozzles is between 50% and 250%, inclusive, of the operating distance.

12. The method of claim 11, further comprising varying the operating temperature of the polymer solution while electrospinning the polymer solution so as to change evaporation rate of the solvent.

13. The method of claim 11, wherein collecting the polymer fiber comprises moving the substrate relative to the nozzle.

14. The method of claim 13, wherein moving the substrate relative to the nozzle comprises varying translation path of the substrate while electrospinning the polymer solution so as to adjust thickness of a membrane formed by the polymer fiber collected on the substrate.

15. A method comprising:

preparing a polymer solution comprising polycaprolactone dissolved in dimethylformamide;

heating the polymer solution to an operating temperature that is between 40° C. and 100° C., inclusive;

feeding the polymer solution to a nozzle;

applying an electrostatic field between a tip portion of the nozzle and a substrate spaced apart from the tip portion of the nozzle by an operating distance, wherein the electrostatic field is configured to draw a charged jet of the polymer solution out of the tip portion of the nozzle toward the substrate; and collecting a fiber on the substrate, wherein the fiber is formed from the charged jet after evaporation of at least some of the dimethylformamide, wherein the nozzle is one of a plurality of nozzles configured to receive the heated polymer solution which is electrospun into charged jets escaping from the plurality of nozzles to form respective polymer fibers on the substrate, wherein a distance between two adjacent nozzles is between 50% and 250%, inclusive, of the operating distance.

16. The method of claim 11, wherein at least one of the plurality of nozzles was at least partially clogged by a polymer precipitate, the method further comprising:

heating the at least one nozzle to a melting temperature sufficient to melt the polymer precipitate into a polymer melt; and pressurizing the polymer melt out of the at least one nozzle through an opening so that the at least one nozzle is unclogged.

17. The method of claim 11, wherein the operating distance is between 10 mm and 20 mm, and an accelerating voltage applied between the tip portion of the nozzle and the substrate is between 10 kV and 20 kV.

18. The method of claim 11, wherein the charged jet remains substantially straight with no whipping along its trajectory until within about 1 mm above the substrate.

19. The method of claim 11, wherein the electrospinning is controlled such that the polymer fiber is deposited on the substrate in one or more localized spots each having a diameter between about 1 mm and about 10 mm.

20. The method of claim 14, wherein varying translation path of the substrate while electrospinning the polymer solution comprises depositing the polymer fiber along a plurality of parallel deposition lines having progressively reduced spacing, thereby producing the membrane whose local thickness progressively increases as the spacing between the deposition lines decreases.

* * * * *